United States Patent [19]

Ondrasik, II

[11] 3,977,389

[45] Aug. 31, 1976

[54] RACK CONSTRAINING APPARATUS

[76] Inventor: Vladimir J. Ondrasik, II, 17044 Westbury Drive, Granada Hills, Calif. 91344

[22] Filed: Apr. 16, 1975

[21] Appl. No.: 565,366

[52] U.S. Cl. ..... 126/337 R; 211/153

[51] Int. Cl.[2] ..... F24C 15/16

[58] Field of Search ..... 126/337 R, 337 A, 338; 211/153; 312/346

[56] References Cited

UNITED STATES PATENTS 2,633,400 3/1953 Ring ..... 211/153 X

FOREIGN PATENTS OR APPLICATIONS 839,696 6/1960 United Kingdom ..... 126/337 R

*Primary Examiner*—Edward G. Favors

*Attorney, Agent, or Firm*—John L. Haller

[57] ABSTRACT

An improved rack constraining apparatus especially adapted to alleviate vibration and rattle when a rack, such as an oven rack, is located in an unstable environment, such as an oven within a recreational vehicle. This device utilizes the outer body wires of the rack itself to bind the support rib between the body wire and the rack frame.

3 Claims, 3 Drawing Figures

RACK CONSTRAINING APPARATUS

BACKGROUND OF THE INVENTION

1. Field of the Invention

This invention relates to an improved rack constraining apparatus which alleviates vibration and rattle of racks, particularly oven racks in recreational vehicles.

2. Description of Prior Art

The problem of vibrating racks has existed since the inception of recreational vehicles. Two basic approaches to solving this problem have been implemented. First, small metal clips are provided which, when fastened around the rack frame and the support rib, clamp the rack frame tightly to the support rib. These clips, however, must be removed before the rack can be used, they often get misplaced, they often vibrate off, and they cannot be installed until the rack is in a specific position. Secondly, similar clips have been welded to the rack frame, but these are difficult to manufacture, are fragile in nature, and become ineffective after moderate use.

SUMMARY OF THE INVENTION

The described invention relates to an improved rack constraining apparatus which holds the rack firmly against the ribs of a host enclosure and thereby prevents vibration and rattling. Specifically, the innovation involves the concept of utilizing a specially-bent outer body wire to create a binding force which secures the rack to the ribs of the host enclosure. The concept of using the existing body wires in this new and novel manner without the necessity of separate retaining clips is the basis of this invention.

The principal object of this invention is to secure oven racks in the ovens of recreational vehicles.

Another object would be to use the invention to secure any appliance rack, such as refrigerators, freezers, and dishwashers in any vehicle such as mobile homes, trailers, campers, boats, planes, trains, and automobiles.

A further object would be to secure a support rack in any form of display stand.

BRIEF DESCRIPTION OF THE DRAWINGS

The following is a brief description of the accompanying drawings.

DESCRIPTION OF THE PREFERRED EMBODIMENT

Figure 1:
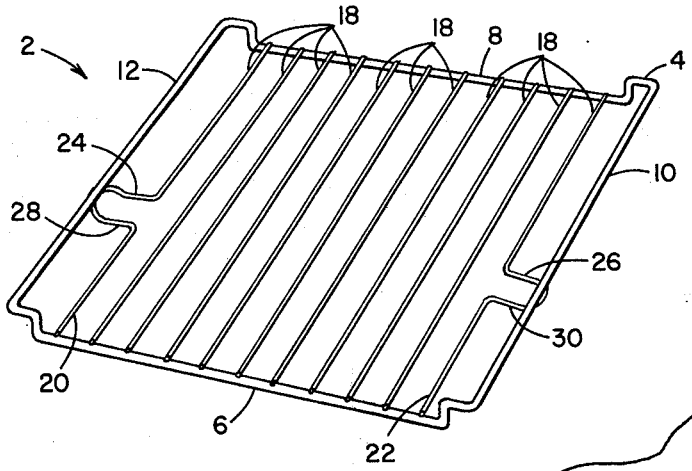
FIG. 1, is an oblique diagram of the improved rack with the constraining apparatus.

Generally, the construction of the improved rack 2 is the same as any standard support rack. The side closest the user when positioning the improved rack into an oven or similar host enclosure 16 is the front end 6. Opposite the front end 6 is the rear end 8 and correspondingly the right side 10 and left side 12. Generally, the rack is slid into the oven or other type of enclosure 16, and, when in a stable environment, gravity retains the standard rack in position on top of ribs 14. However, where the environment is unstable, the standard rack vibrates, rattles, and creates an immediate source of irritation.

Like the standard rack this improved rack is constructed of a rack frame 4, usually a heavy gauge steel support wire, and smaller gauge steel body wires 18. FIG. 1 clearly shows the basic construction of the improved rack.

Figure 2:
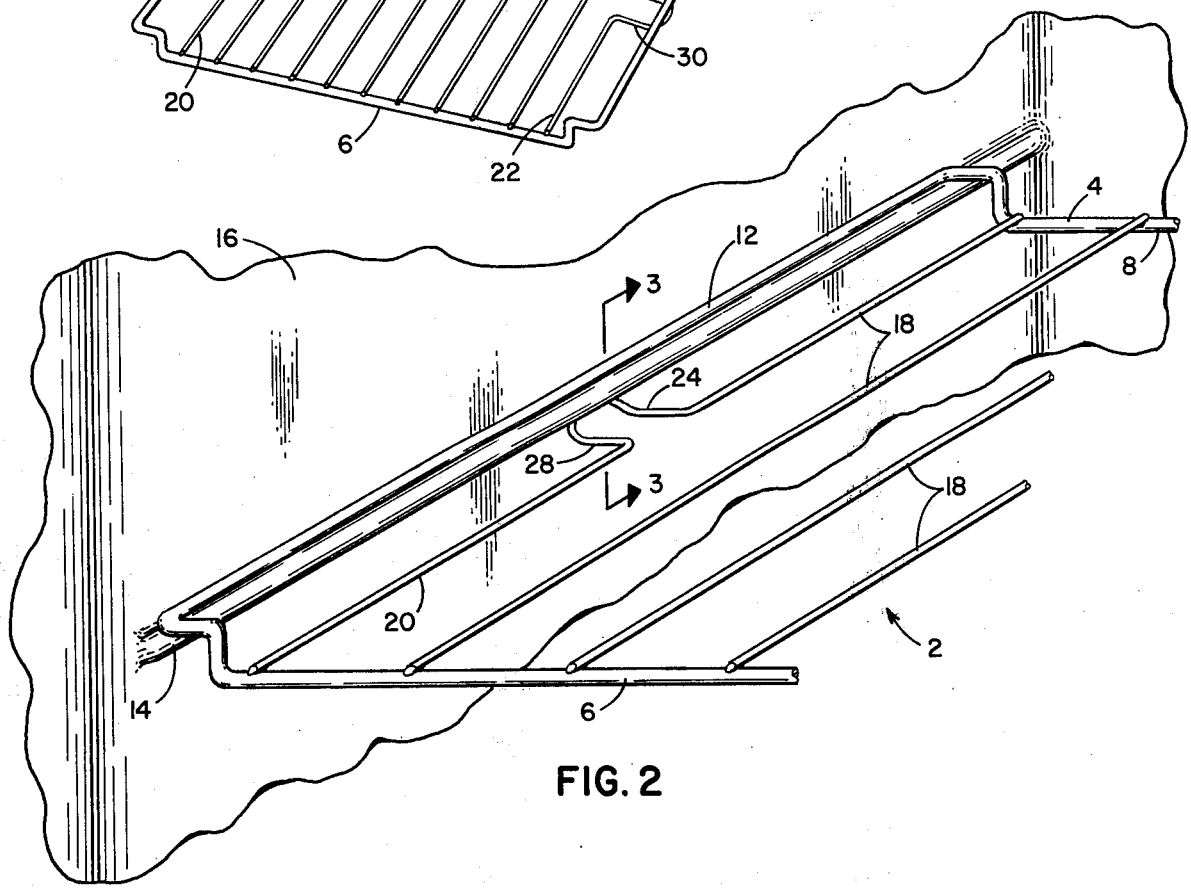
FIG. 2, is an oblique view of the left holding device showing the rack's cooperation with the ribs of a host enclosure.
Figure 3:
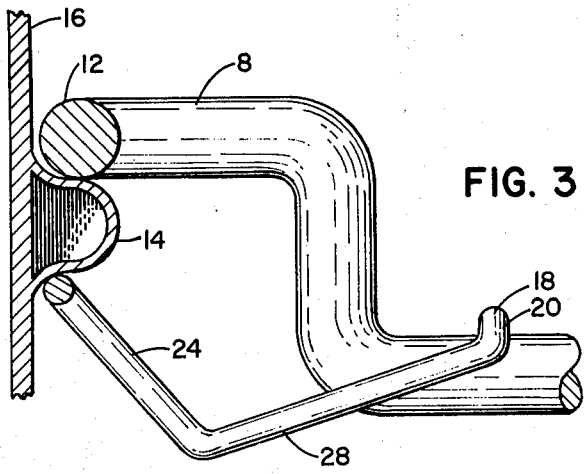
FIG. 3, is a cross section view of the left holding device taken at approximately 3—3 of FIG. 2.

The Rack Constraining Apparatus utilizes the left-most body wire 20 and the right-most body wire 22 specially formed with a left projection 28 and a right projection 30 to develop a corresponding left holding device 24 and right holding device 26. The left projection 28 and right projection 30 are specially formed so that they extend out and slant up at the outer edge to touch the underside of the left side 12 and right side 10, respectively, of the rack frame 4. As FIGS. 2 and 3 show, when the rack is slid into position on top of ribs 14, the left-most body wire 20 is bent down and under the left rib 14. This bending down and under creates a torsion moment on the left-most body wire 20. The tendency of the left-most body wire 20 to return to its original position binds the left rib 14 between the left side 12 of the rack frame 4 and the left-most body wire 20. This operation describes the left holding device 24. The right holding device is an analogous operation on the right side of the rack. The torsion moment imposed upon the left-most body wire 20 and the right-most body wire 22 creates a significant binding action on the corresponding left rib 14 and right rib, respectively, which securely holds the improved rack 2 to the host enclosure 16.

To easily construct the holding device, a standard body wire need only be bent into a U-shaped projection extending far enough to touch the frame. A slight bend up of the U-shaped projection helps create a greater torsion moment when the rack is properly in place. Once the body wire is properly formed, the body wire is merely attached to the frame in the standard fashion (usually spot welding).

While other specific variations of the concept could easily be developed, the precise structure described above is considered best for fabricating racks incorporating the improved rack constraining apparatus.

Using the above description those skilled in the particular art of rack fabrication could easily construct this or variant forms of this rack constraining apparatus. Such variant forms are to be considered within the scope and essence of this invention.

What is claimed is:

1. An improved rack of the type having a rack frame rectangular in shape with a front end, a rear end, a left side, and a right side which is supported in a host enclosure by a pair of longitudinal ribs, a left rib and a right rib, where the left side of the rack frame rests on top of the left rib and the right side of the rack frame rests on top of the right rib, and a plurality of body wires each of which is attached at one end to the front of the rack frame and at the other end to the rear of the rack frame, wherein the improvement comprises: a means for constraining the rack frame to the longitudinal ribs by a left holding device which binds the left rib between the left side of the rack frame and the left-most body wire, and a right holding device which binds the right rib between the right side of the rack frame and the right-most body wire.

2. An improved rack as recited in claim 1, in which the constraining means comprises: a left holding device which binds the left rib between the left side of the rack frame and the left-most body wire; where the left-most body wire has a left projection extending to the left as far as is necessary to touch the underside of the left rib; and where the left projection is bent down and under the left rib therein creating a binding force between the left-most body wire, the left rib, and the left side of the rack frame when the rack frame is slid into position on top of the longitudinal ribs; and a right holding device which binds the right rib between the right side of the rack frame and the right-most body wire; where the right-most body wire has a right projection extending to the right as far as is necessary to touch the underside of the right rib and where the right projection is bent down and under the right rib therein creating a binding force between the right-most body wire, the right rib, and the right side of the rack frame when the rack frame is slid into position on top of the longitudinal ribs.

3. An improved rack as recited in claim 2, wherein the left projection is extended beyond the underside of the left side of the rack frame to a point which continues to permit the rack frame to slide into position on top of the longitudinal ribs within the host enclosure and where the left projection has an upward slant at the outer edge which causes more of a bend downward and under the left rib creating a torsion moment on the left-most body wire, thus producing a binding force on the left rib by the left-most body wire and the left side of the rack frame when the rack frame is slid into position on top of the longitudinal ribs; and the right projection is extended beyond the underside of the right side of the rack frame to a point which continues to permit the rack frame to slide into position on top of the longitudinal ribs within the host enclosure and where the right projection has an upward slant at the outer edge which causes more of a bend downward and under the right rib creating a torsion moment on the right-most body wire, thus producing a binding force on the right rib by the right-most body wire and the right side of the rack frame when the rack frame is slid into position on top of the longitudinal ribs.

* * * * *